United States Patent [19]

Mowbray

[11] Patent Number: 4,522,182

[45] Date of Patent: Jun. 11, 1985

[54] FUEL SYSTEM FOR COMPRESSION IGNITION ENGINE

[75] Inventor: Dorian F. Mowbray, Burnham, England

[73] Assignee: Lucas Industries plc, Birmingham, England

[21] Appl. No.: 399,812

[22] Filed: Jul. 19, 1982

[30] Foreign Application Priority Data

Jul. 24, 1981 [GB] United Kingdom ..... 8122968
Mar. 23, 1982 [GB] United Kingdom ..... 8208400

[51] Int. Cl.[3] ..... F02M 39/02

[52] U.S. Cl. ..... 123/509; 123/470; 239/600

[58] Field of Search ..... 123/507, 508, 509, 470, 123/471, 472; 239/600, 88–95, 533.1–533.12; 417/499, DIG. 1

[56] References Cited

U.S. PATENT DOCUMENTS

| | | | |
|---|---|---|---|
| 1,863,232 | 6/1932 | Woolson | 123/509 |
| 2,354,403 | 7/1944 | Reggio | 123/509 |
| 4,213,564 | 7/1980 | Hulsing | 123/470 |

FOREIGN PATENT DOCUMENTS

| | | | |
|---|---|---|---|
| 42814 | 3/1938 | Netherlands | 123/508 |

*Primary Examiner*—Carl Stuart Miller

[57] ABSTRACT

A fuel system for a compression ignition engine includes a body defining a mounting for a fuel injection nozzle. The body also accommodates a reciprocable piston fuel pump having a piston which is actuable by an engine driven cam. The body also defines a surface which in use locates against a surface on the engine cylinder head. The surface is well removed from the bore in the cylinder head of the engine which contains the injection nozzle. In this manner forces applied to the body during operation of the system are applied to the cylinder head of the engine in an area which is sufficient strong to withstand the forces.

3 Claims, 4 Drawing Figures

FUEL SYSTEM FOR COMPRESSION IGNITION ENGINE

This invention relates to a fuel system for a compression ignition engine and of the kind including a reciprocable plunger fuel injection pump having an outlet, and a fuel injection nozzle having an inlet connected to said outlet.

It has been the practice to mount the pump or pumps in a pump body which in use is attached to the engine structure at a position such that the injection pump can be driven by the engine, the pump or pumps being connected to the nozzle or nozzles by means of pipes. In an effort to reduce the injection period that is to say the period considered in terms of degrees of engine crank shaft rotation, during which fuel is supplied to the combustion chamber of the engine, it has been proposed to construct the injection nozzle in unit with the pump. The pump in this case is driven by a cam which may be provided on the engine cam shaft, through a suitable rocker. In known arrangements the axis of the nozzle is aligned with the axis of the pump plunger. The nozzle body extends into the combustion chamber of the engine and usually has a step which locates and is clamped against a step defined in a bore provided to accommodate the nozzle.

The cylinder head of an engine and in particular that portion which forms the wall of the combustion chamber is provided with a number of passages for example, the air inlet passage and the exhaust passage as well as passages for coolant and drillings which accommodate the stems of the valves. In the case of large engines it is possible to ensure that there is adequate support for the aforesaid step so that the clamping loads and also the mechanical loads imparted to the pump by the action of the cam during the delivery of fuel, can be absorbed. For small high speed engines the problem of providing adequate support is much more acute particularly as the size of the injection nozzle may not be smaller in proportion.

The object of the invention is to provide a fuel system for a compression ignition engine in a simple and convenient form.

According to the invention a fuel system for a compression ignition engine comprises a body adapted to be mounted on the cylinder head of the engine, a mounting formed integrally with the body, and a fuel injection nozzle carried by said mounting, said fuel injection nozzle extending in use through a bore in the cylinder head into a combustion space of the engine, an injection pump including a reciprocable plunger accommodated in the body, the line of action of the plunger being out of line with the axis of the nozzle and a surface defined on said body, for engagement with a complementary surface on the cylinder head of the engine, said surface acting to transmit to the cylinder head at least some of the forces to which the body is subjected during operation of the pump.

Figure 1:
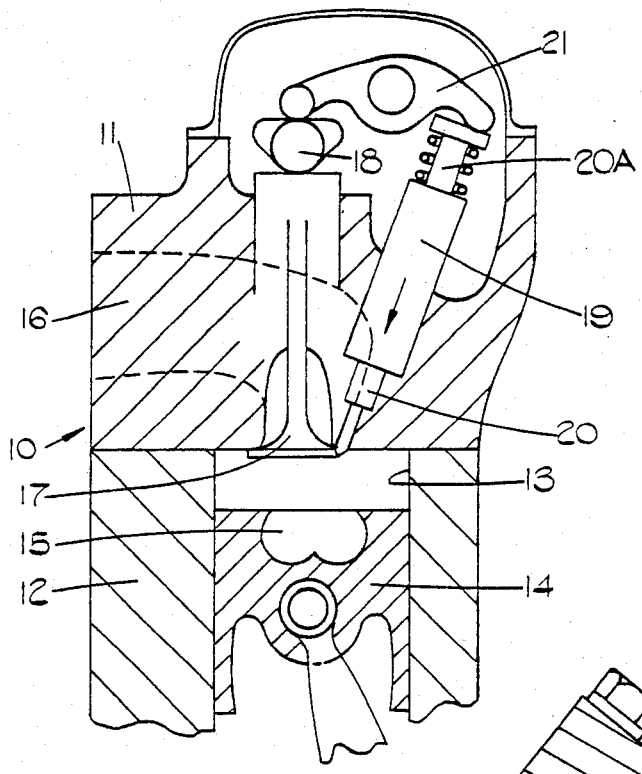
Figure 2:
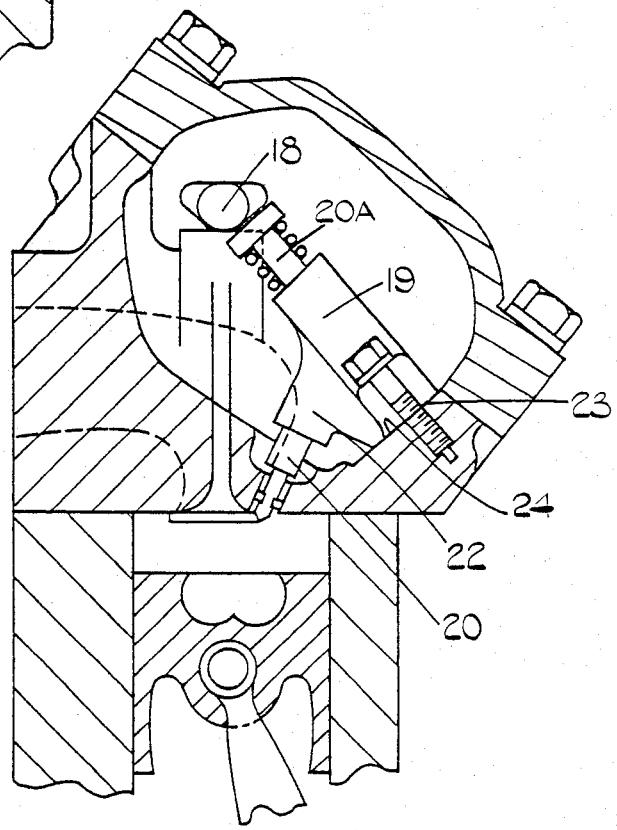
Figure 3:
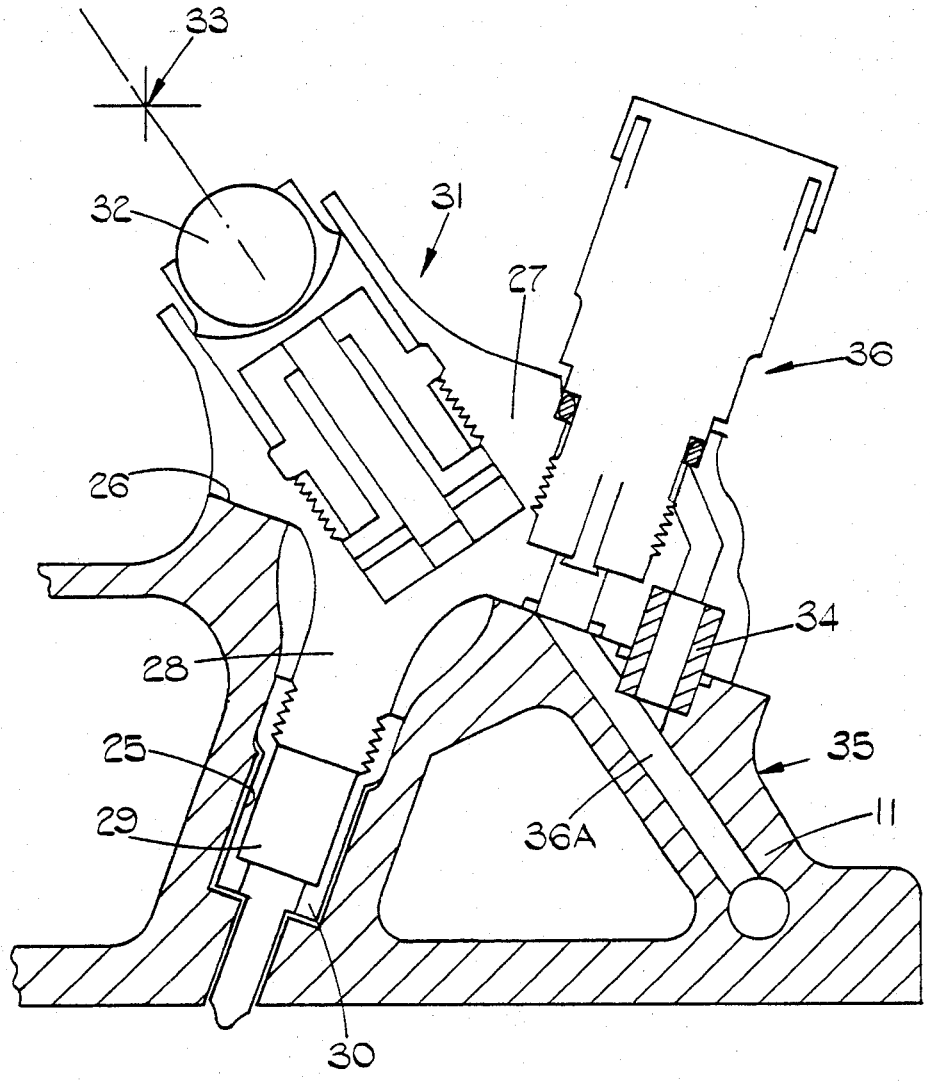
Figure 4:
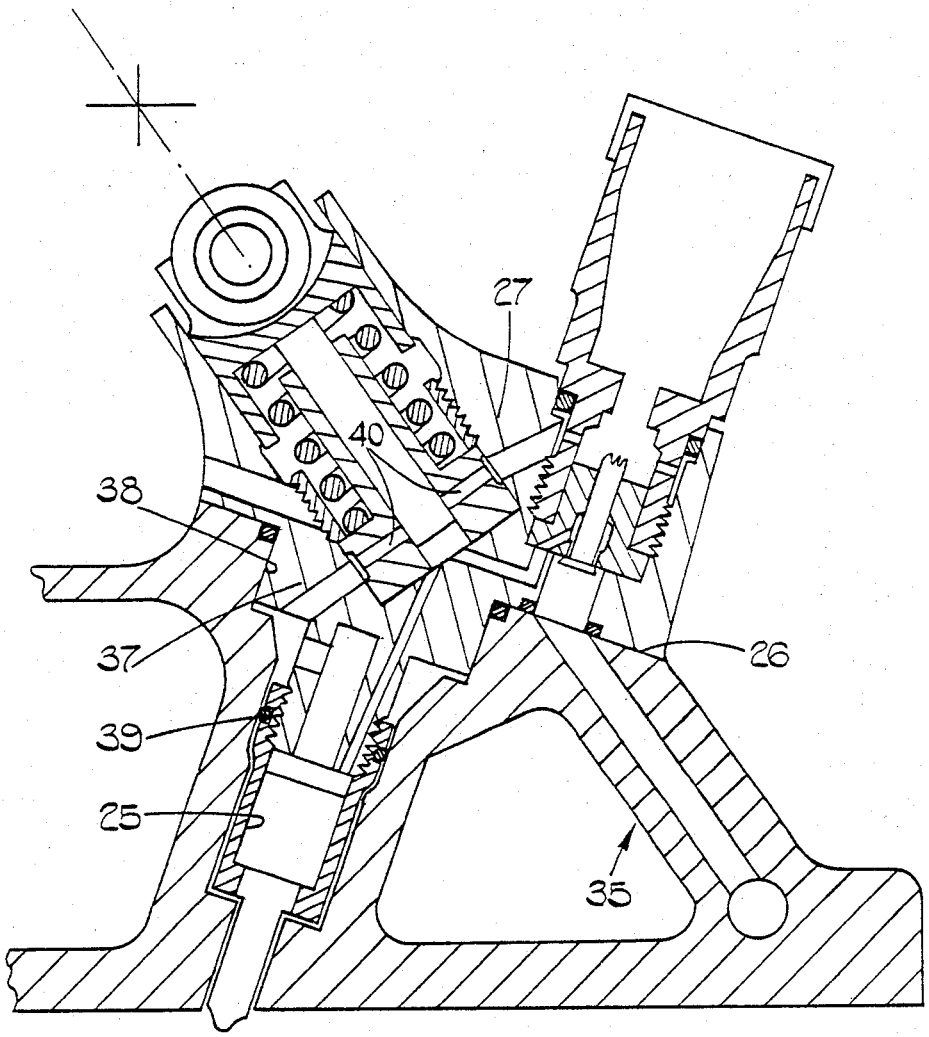

In the accompanying drawings:

FIG. 1 is a diagrammatic sectional side elevation illustrating an engine cylinder head with a known form of fuel system; and FIGS. 2, 3, and 4 are views similar to FIG. 1 showing examples of fuel system modified in accordance with the invention.

Referring to FIG. 1 of the drawings an engine is indicated generally at 10 and includes a cylinder head

11 which is bolted in known manner to the engine block 12. The latter in the usual fashion is provided with a cylinder or cylinders 13 locating pistons 14. In the particular example, the piston is recessed to define a combustion chamber 15.

Formed in the cylinder head is a pair of passages one of which is shown at 16, which act to convey combustion air and exhaust gas respectively to and from the combustion space. The diagram below the main portion of the Figure illustrates the port openings into the wall of the cylinder head which constitutes the upper wall of the combustion chamber. Poppet valves one of which is indicated at 17, control gas flow through the aforesaid passages and the valves are actuated by cams respectively formed on a cam shaft 18 supported by the cylinder head.

The fuel system includes a combined fuel pump and injection nozzle, the pump portion being indicated at 19 and the injection nozzle at 20. The latter has a tip which extends through the aforesaid face of the cylinder head and incorporated in the tip in known manner, is an outlet orifice or orifices through which fuel is directed into the combustion chamber.

The pump portion 19 includes a body to which the injection nozzle 20 is secured and it also has a plunger 20A a portion of which projects from the body for engagement by a rocker level 21 which is actuated by a cam on the cam shaft 18. The axis of movement of the plunger 20A is aligned with the axis of the injection nozzle. The injection nozzle is of stepped form and the bore in the cylinder head through which the nozzle extends is of complementary form so that by means of clamps not shown, a gas tight seal can be obtained between the step in the bore and the step on the injection nozzle body. The step in the bore must be able to withstand the clamping loads and also the axial thrust which is imparted to the plunger during the delivery of fuel. In addition to the passages 16 the cylinder head will also incorporate coolant passages. Moreover, it will be noted that the injection nozzle is positioned substantially midway between the valves and as a result the cylinder head in this zone is relatively weak. In large engines it is possible to provide the step in the bore with sufficient support so that it can withstand the clamping loads and also the axial thrust imparted to the plunger. In small engines however the problem of providing support for the step is much more acute and it is for this reason that the modified form of fuel system has been designed.

Turning now to FIG. 2 in which identical reference numerals are utilized wherever possible. In the arrangement of FIG. 2 the pump body 19 is provided with a lateral extension 22 upon which is mounted the fuel injection nozzle 20. The axis of the plunger 20A and the nozzle 20 are now inclined relative to each other and the pump body defines a surface 23 for engagement with a complementary surface 24 defined on the cylinder head of the engine at a position removed from the passages 16. The surface 24 absorbs the thrust imparted to the plunger 20A by the cam and it is also subjected to a clamping force which is of reduced magnitude by reason that the seal between the injection nozzle 20 and the bore in which it is located, is of different type. A compression seal is no longer employed, the seal comprising an annular ring which is located in a groove formed in the injection nozzle body, the ring engaging with the wall of the bore in which the injection nozzle is mounted so as to establish a gas tight seal.

It will also be noted that by using this construction it is possible to eliminate the rocker lever 21 but this is only because in the particular example, the axis of movement of the plunger 20A is aligned with the axis of rotation of the cam. In other designs the inclination between the axes may be less so that the axis of the plunger is for example vertical. In this case it would be necessary to provide a rocker lever 21 or a separate cam shaft.

In the arrangement shown in FIG. 3 the cylinder head is provided with a stepped bore 25 which in use, extends to the combustion chamber of the engine. The cylinder head is provided with a mounting surface 26 against which is located a complementary surface on a pump body 27. The pump body 27 has an extension 28 which mounts a fuel injection nozzle 29 the latter being secured to the extension by means of the conventional form of cap nut 30.

The body 27 and the extension together with the cap nut, are so dimensioned that a small clearance exists between the cap nut 30 and the step defined in the bore 25 and in order to provide a seal between the cap nut and the step, a washer is provided which may be of the corrugated type. The axis of the nozzle is at right angles to the surface on the body which is complementary to the surface 26. The body also mounts a pump portion which is generally indicated at 31 and which is of the reciprocating plunger type. Forming part of the pump is a roller 32 which in use, is actuated by a cam mounted on a cam shaft not shown but having a rotary axis which is generally indicated at 33. The axis of the pump is offset relative to the axis of the nozzle and bolts are provided to retain the body relative to the cylinder head. The surface 26 is disposed away from the step in the bore 25 and can be made of sufficient strength to withstand the pumping force. However, the line of action of the cam is at an angle to the aforesaid surface. As a result, there is a force acting in the direction parallel to the surface 26 and in order to absorb this force, a dowel 34 is located in the body 27 and enters into a complementary recess in the cylinder head. The dowel and the recess defined cylindrical surfaces which act to absorb the force. The dowel conveniently is of hollow cylindrical form having its axis at right angles to the surface 26 and parallel to the axis of the nozzle 29. It is convenient to form part of the cylinder head as a strut 35 which is generally aligned with the axis of the pump 31. In this manner the forces which are generated by the action of the cam will be applied to the cylinder head of the engine at a position removed from the cylinder.

In FIG. 3 a control valve generally indicated at 36 is provided which is used to control the amount of fuel which is delivered by the pump to the associated engine. Conveniently the strut 35 is formed with a drilling 36A which forms a fuel passage, the dowel also providing a fuel flow path associated with the valve 36.

FIG. 4 shows in greater detail the various fuel passages within the body 27 but it also illustrates a modification to the arrangement shown in FIG. 3. In the arrangement of FIG. 4 the dowel 34 is omitted and its place is taken by a cylindrical extension 37 formed on the body 27 and which is a close fit within a complementary recess 38 defined in the cylinder head, the extension 37 and recess 38 defining cylindrical surfaces which act to absorb forces produced as a result of the pumping action. Again the strut 35 is provided and this provides support for the portion of the wall of the recess 38 which in use, will tend to support the extension 37 against the side loads resulting from the action of the cam against the roller. FIG. 4 also shows the provision of the sealing ring 39 to establish a seal between the cap nut and the bore 25 in which it is located. As will be seen, the space defined between the extension 37 and the seal 39 is supplied with fuel for filling the pump cylinder via ports 40. Additional sealing rings are provided between the surface 26 and the body 27.

I claim:

1. A fuel system for a compression ignition engine comprising a body adapted to be mounted on the cylinder head of the engine, a mounting formed integrally with the body, and a fuel injection nozzle carried by said mounting, said fuel injection nozzle extending in use through a bore in the cylinder head into a combustion space of the engine, an injection pump including a reciprocable plunger accommodated in the body, the line of action of the plunger being out of line with the axis of the nozzle, and a surface defined on said body for engagement with a complementary surface on the cylinder head of the engine, said surface acting to transmit to the cylinder head at least some of the forces to which the body is subjected during operation of the pump, said body defining a second surface which extends substantially at right angles to the axis of the nozzle, said second surface being clamped in use to a further surface on the cylinder head of the engine, said first mentioned surface on the body extending substantially at right angles to said second surface.

2. A fuel system according to claim 1 in which said first mentioned surface is defined by a cylindrical extension carried by the body.

3. A fuel system according to claim 1 in which said first mentioned surface is defined by a dowel carried by the body.

* * * * *